US009266343B2

(12) United States Patent
Igawa

(10) Patent No.: US 9,266,343 B2
(45) Date of Patent: Feb. 23, 2016

(54) INK PACK

(71) Applicant: MIMAKI ENGINEERING CO., LTD., Nagano (JP)

(72) Inventor: Tomomi Igawa, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/078,540

(22) Filed: Nov. 13, 2013

(65) Prior Publication Data

US 2014/0132679 A1 May 15, 2014

(30) Foreign Application Priority Data

Nov. 14, 2012 (JP) ..... 2012-250710

(51) Int. Cl.
*B41J 2/175* (2006.01)
*B65D 1/40* (2006.01)
*B65D 6/28* (2006.01)

(52) U.S. Cl.
CPC .... *B41J 2/17559* (2013.01); *B41J 2002/17516* (2013.01)

(58) Field of Classification Search
USPC ..... 347/85, 86; 220/62.17, 62.21, 62.22, 220/610; 206/218; 428/35.8, 35.9
See application file for complete search history.

(56) References Cited

U.S. PATENT DOCUMENTS

| | | | | |
|---|---|---|---|---|
| 4,415,886 | A * | 11/1983 | Kyogoku et al. | 340/618 |
| 5,971,533 | A * | 10/1999 | Kinoshita et al. | 347/86 |
| 6,220,702 | B1 * | 4/2001 | Nakamura et al. | 347/86 |
| 6,276,787 | B1 * | 8/2001 | Sakanobe et al. | 347/86 |
| 6,582,068 | B2 * | 6/2003 | Ishizawa et al. | 347/85 |
| 7,364,283 | B2 * | 4/2008 | Nakajima | 347/86 |
| 7,560,150 | B2 * | 7/2009 | Shiokawa et al. | 428/36.6 |
| 8,197,045 | B2 * | 6/2012 | Takeuchi | 347/86 |

FOREIGN PATENT DOCUMENTS

JP 2000-238291 9/2000

* cited by examiner

*Primary Examiner* — Anh T. N. Vo
(74) *Attorney, Agent, or Firm* — Jianq Chyun IP Office

(57) ABSTRACT

Ultraviolet curable ink contained in an ink pack is prevented from curing during storage. The second resin layer, the metal layer, and the protective layer in the upper film of the surface portion of the ink pack extend from the base layer (extended portion). The metal layer has a light-shielding property, and the extended portion is folded back and attached to the surface of the lower film of the side-surface portion. The metal layer having a light-shielding property thus covers the base layers exposed at the end surface of the joint portion, and can prevent external ultraviolet rays from reaching the ink through the base layers.

1 Claim, 7 Drawing Sheets

FIG.3A
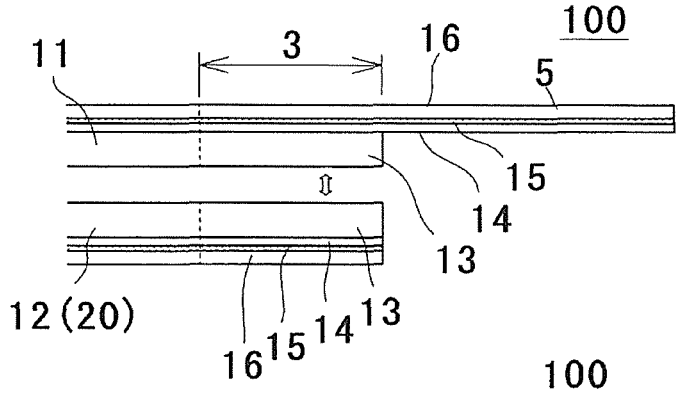
FIG.3B
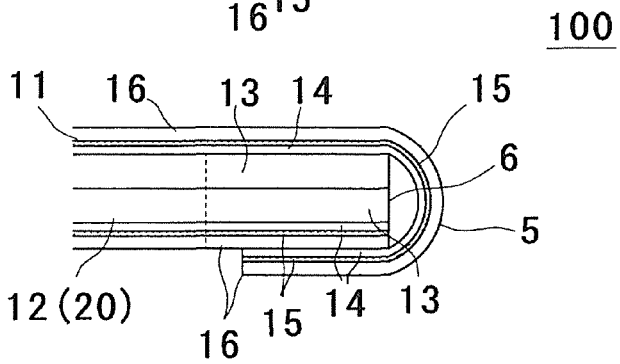
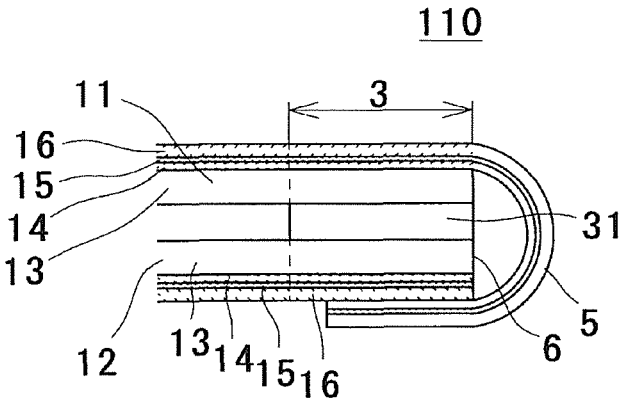
FIG.4

FIG.5A
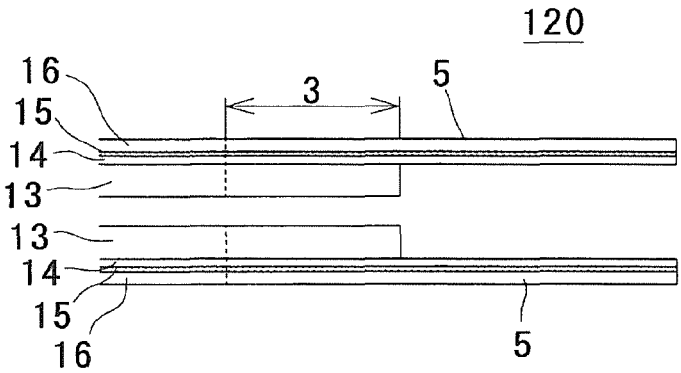
FIG.5B
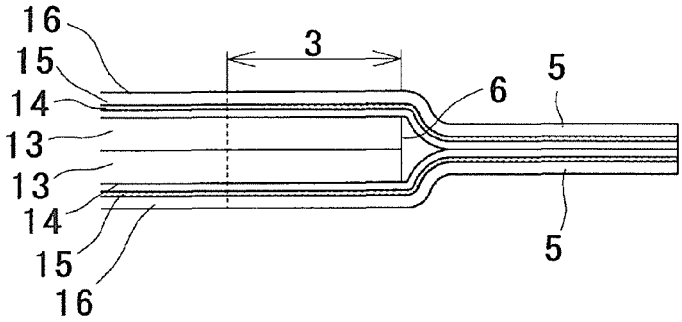
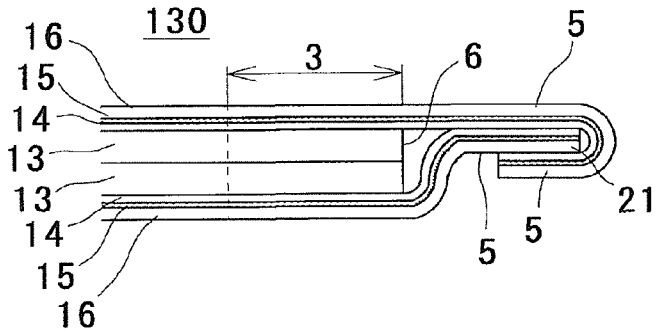
FIG.6

INK PACK

CROSS-REFERENCE TO RELATED APPLICATIONS

This application claims the priority benefit of Japan application serial no. 2012-250710, filed on Nov. 14, 2012. The entirety of the above-mentioned patent application is hereby incorporated by reference herein and made a part of this specification.

BACKGROUND OF THE INVENTION

1. Field of the Invention

The present invention relates to an ink pack for sealing an ultraviolet curable ink therein.

2. Description of Related Art

An ink pack is known as disclosed in JP-A-2000-238291. FIG. 12 is a breakaway view illustrating an example of the ink pack of related art. An ink pack 900 includes a surface portion 902 formed of a pair of upper and lower first films 901, and a side-surface portion 904 formed of a pair of left and right second films 903. The surface portion 902 has a laminate structure of a polyethylene layer, a polyester layer, an aluminum layer, and a polyester layer. The side-surface portion 904 has a laminate structure of a polyethylene layer, an aluminum layer, and a nylon layer.

The body of the ink pack 900 is formed by heat fusion. Specifically, the base layer (polyethylene layer) at longer-side portions 905 of the surface portion 902 is heat fused with the opposing base layer (polyethylene layer) at longer-side portions 906 of the side-surface portion 904. Similarly, the opposing polyethylene layers of the surface portion 902 are heat fused at the shorter-side portions (not illustrated) on one side of the surface portion 902. An ink supply opening 907 is provided on the other side of the surface portion 902. FIG. 13 is a partially magnified cross sectional view of the ink pack shown in FIG. 12. As illustrated in the figure, the base layers are exposed on an end surface 910 at a joint portion 908 where the longer-side portions 905 are heat fused to each other.

There has been significant increase of ink consumption in inkjet printers, and the amount of ink sealed in an ink pack has been increasing in proportion. The larger ink amount requires a fair amount of strength in the ink pack itself, particularly at the heat fused portion. At present, the film base layer is provided as a 150 μm- to 200 μm-thick layer to ensure sealing of the ink at the joint portion while maintaining strength for the whole ink pack.

SUMMARY OF THE INVENTION

There is a documented phenomenon where the ultraviolet curable ink sealed inside the ink pack undergoes curing with time during storage. However, the cause of such a phenomenon has not been ascertained. After efforts to find the cause, the present inventor found that the curing of the sealed ink was due to the entry of ultraviolet rays through the thick joint portion provided to maintain strength. The present invention focused on this problem, and found a solution.

According to a first aspect of the present invention, there is provided an ink pack formed by joining films into a form of a bag for sealing an ultraviolet curable ink therein, wherein the films have a multilayer structure that includes a base layer of resin and a light-shielding layer laminated on the base layer, and are joined to each other at end portions of the respective base layers, one of the films having an extended portion as a portion of the light-shielding layer extending from the base layer, the extended portion being folded back and covering an end surface of the joint portion of the end portions.

According to this aspect of the invention, the extended portion of the light-shielding layer is folded back to cover the end surface of the joint portion, and prevents entry of ultraviolet rays through the base layer. The ink inside the ink pack thus does not undergo curing during storage. The end portions include both the longer-side portions and the shorter-side portions of the films. A layer other than the base layer and the light-shielding layer also may be laminated.

According to a second aspect of the invention, there is provided an ink pack formed by joining films into a form of a bag for sealing an ultraviolet curable ink therein, wherein the films have a multilayer structure that includes a base layer of resin and a light-shielding layer laminated on the base layer, and are joined to each other at end portions of the respective base layers, the films each having an extended portion as a portion of the light-shielding layer extending from the base layer, the extended portions being joined to each other.

Because the extended portions of the light-shielding layers are joined to each other, the end surface of the joint portion can be covered by the light-shielding layers. This prevents entry of ultraviolet rays through the base layers, and the ink sealed inside the ink pack does not undergo curing during storage. The end portions include both the longer-side portions and the shorter-side portions of the films. A layer other than the base layer and the light-shielding layer also may be laminated.

According to a third aspect of the invention, there is provided an ink pack formed by joining films into a form of a bag for sealing an ultraviolet curable ink therein, wherein the films have a multilayer structure that includes a base layer of resin and a light-shielding layer laminated on the base layer, and are joined to each other at end portions of the respective base layers, the films each having an extended portion as a portion of the light-shielding layer extending from the base layer, the extended portions being joined to each other, one of the extended portions being folded back and joined at the end portion of other films.

According to this aspect of the invention, one of the extended portions including the light-shielding layer is folded back at the end portion of other films. This makes it possible to improve the ultraviolet blocking effect, and the strength of the end portions.

An ink pack according to a fourth aspect of the invention preferably includes a joint layer of resin between the base layers and in a portion that becomes the joint portion. In this way, the joint strength at the end portions can further improve while blocking ultraviolet rays.

According to a fifth aspect of the invention, there is provided an ink pack formed by joining films into a form of a bag for sealing an ultraviolet curable ink therein, wherein the films have a multilayer structure that includes a base layer of resin and a light-shielding layer laminated on the base layer, and are joined to each other at end portions of the respective base layers, the base layers being configured from ultraviolet blocking resin.

Because the base layers are formed of ultraviolet blocking resin, there is no entry of ultraviolet rays into the ink pack even when the base layers are exposed at the end surface. The ink sealed in the ink pack can thus be prevented from curing during storage.

According to a sixth aspect of the present invention, there is provided an ink pack formed by joining films into a form of a bag for sealing an ultraviolet curable ink therein, wherein the films have a multilayer structure that includes a base layer of resin and a light-shielding layer laminated on the base layer, and are joined to each other at end portions of the respective base layers, and wherein the ink pack includes a joint layer configured from ultraviolet blocking resin and provided between the base layers and in a portion that becomes the joint portion.

Because the ultraviolet blocking resin is provided between the base layers, the ultraviolet rays that enter the base layers at the joint portion can be absorbed and blocked. The ink sealed in the ink pack can thus be prevented from curing during storage.

According to a seventh aspect of the invention, there is provided an ink pack formed by joining films into a form of a bag for sealing an ultraviolet curable ink therein, wherein the films have a multilayer structure that includes a base layer of resin and a light-shielding layer laminated on the base layer, and are joined to each other at end portions of the respective base layers, one of the films having an extended portion as a portion of the light-shielding layer extending from the base layer, and wherein the ink pack includes a coating layer of ultraviolet blocking resin covering an end surface of the joint portion of the end portions by being formed on the extended portion including the end surface.

Because the coating layer of ultraviolet blocking resin is formed on the extended portion including the end surface, entry of ultraviolet rays from the end surface can be prevented. There accordingly will be no curing of the sealed ink during storage.

According to an eighth aspect of the invention, there is provided an ink pack formed by joining films into a form of a bag for sealing an ultraviolet curable ink therein, wherein the films have a multilayer structure that includes a base layer of resin and a light-shielding layer laminated on the base layer, and are joined to each other at end portions of the respective base layers, and wherein the ink pack includes a tape-like sealing element that includes a light-shielding layer and covers an end surface of the joint portion of the end portions.

According to this aspect of the invention, the sealing element having a light-shielding property covers the end portion of the joint portion, and prevents entry of ultraviolet rays through the base layers. There accordingly will be no curing of the sealed ink during storage. The end portions include both the longer-side portions and the shorter-side portions of the films.

The present invention can prevent curing of the sealed ink during storage by preventing entry of ultraviolet rays through the resin base layer.

BRIEF DESCRIPTION OF THE DRAWINGS

FIGS. 3A and 3B are cross sectional views at A-A of FIG. 2.

FIG. 4 is a cross sectional view illustrating a joint portion of an ink pack according to a variation of First Embodiment.

FIGS. 5A and 5B are cross sectional views illustrating a joint portion of an ink pack according to a variation of First Embodiment.

FIG. 6 is a cross sectional view illustrating a joint portion of an ink pack according to another variation of First Embodiment.

DETAILED DESCRIPTION OF THE INVENTION

First Embodiment

Figure 1:
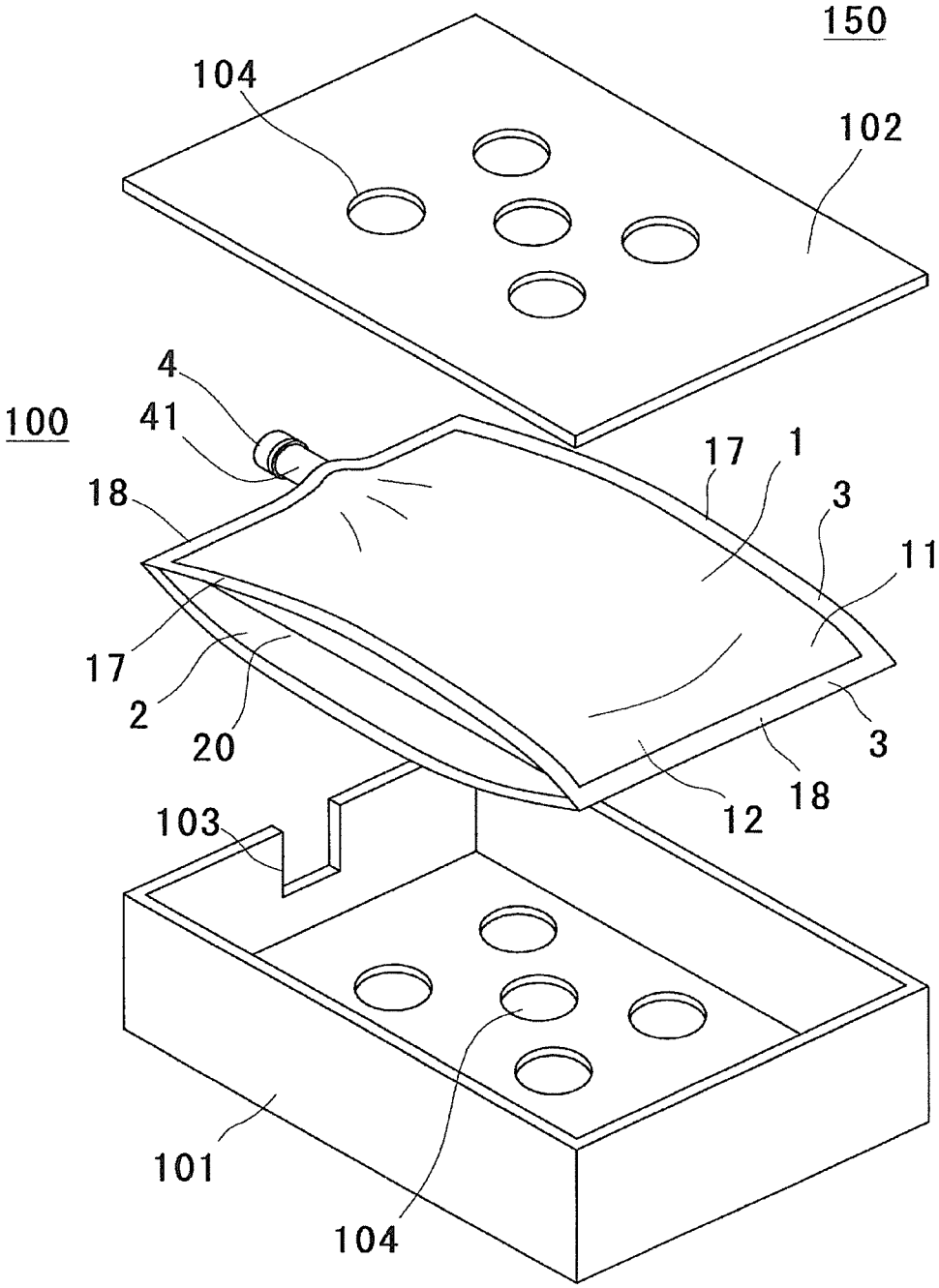
FIG. 1 is an assembly diagram illustrating a cartridge for an ink pack according to an embodiment of the present invention.
Figure 2:
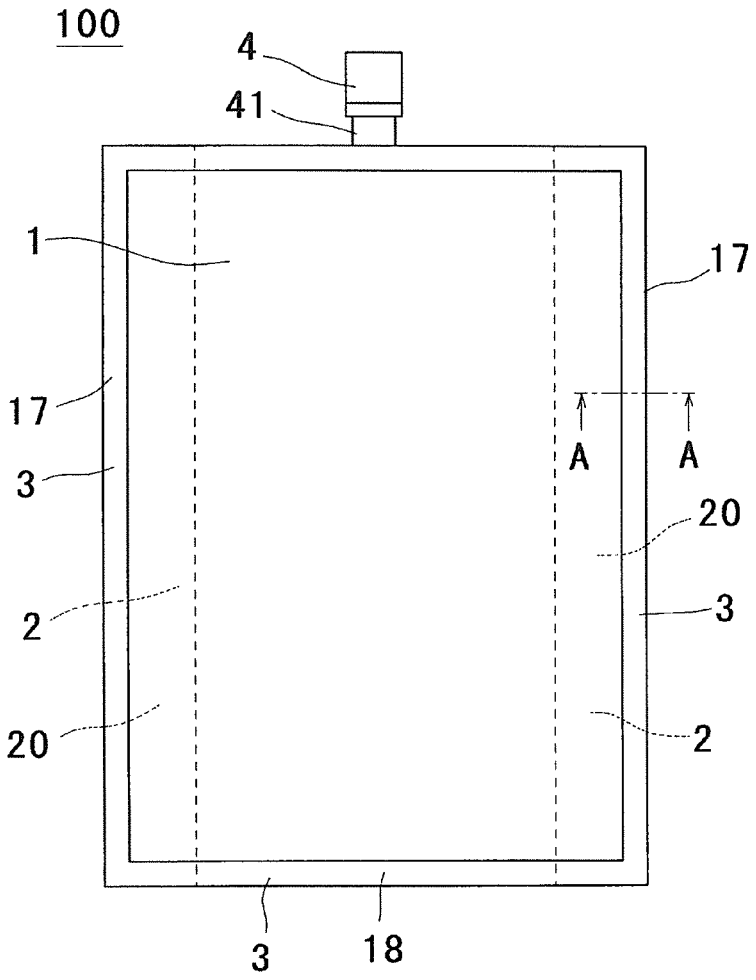
FIG. 2 is a plan view of the ink pack shown in FIG. 1.

FIG. 1 is an assembly diagram illustrating a cartridge for an ink pack according to First Embodiment of the present invention. FIG. 2 is a plan view of the ink pack shown in FIG. 1. FIGS. 3A and 3B are cross sectional views at A-A of FIG. 2. An ink pack 100 is formed by heat fusing a surface portion 1 and a side-surface portion 2 into a form of a bag. The surface portion 1 is formed of a rectangular upper film 11 and a rectangular lower film 12. The upper film 11 and the lower film 12 have a multilayer structure. For example, each film is formed as a laminate of a polyethylene film as a base layer 13, a polyester layer as a second resin layer 14, an aluminum film as a light-shielding metal layer 15, and a polyester film as a protective layer 16, in this order.

The side-surface portion 2 is configured as a rectangular film creased at the center, and has substantially the same length as the surface portion 1. The side-surface portion 2 is provided on each side of the surface portion 1. The side-surface portion 2 is formed of a rectangular film 20. The film 20 has a multilayer structure, and, for example, is formed as a laminate of a polyethylene film as the base layer 13, a polyester layer as the second resin layer 14, an aluminum film as the metal layer 15, and a polyester film as the protective layer 16, in this order.

For example, the base layer 13 has a thickness of 120 μm, the second resin layer 14 has a thickness of 15 μm, the metal layer 15 has a thickness of 9 μm, and the protective layer 16 has a thickness of 16 μm.

As illustrated in FIG. 3A, the polyethylene layer at longer-side portion 17 of the surface portion 1 is opposed to the polyethylene layer at longer-side portion 17 of the side-surface portion 2, and these are heat fused to seal the ink pack 100 as shown in FIG. 3B. An end surface 6 at a joint portion 3 has a thickness D of 300 μm to 400 μm. The opposing polyethylene layers of the upper film 11 and the lower film 12 are also heat fused at shorter-side portions 18 on one side of the surface portion 1. The joint portion 3 has a thickness D of 300 μm to 400 μm.

An ink supply opening 4 is provided at the center on the other shorter side of the surface portion 1. The ink supply opening 4 is configured by wrapping and bonding one end of a resin cylindrical body 41 with the shorter-side portions 18 of the upper film 11 and the lower film 12.

The second resin layer 14, the metal layer 15, and the protective layer 16 in the upper film 11 of the surface portion 1 extend beyond the base layer 13 (extended portion 5). Because the metal layer 15 has a light-shielding property, the extended portion 5 is folded back and attached to the surface of the lower film 12 of the side-surface portion 2. In this way, the metal layer 15 having a light-shielding property covers the base layers 13 (polyethylene layers) exposed at the end surface 6 of the joint portion 3, and can prevent the external ultraviolet rays from reaching the ink through the base layers 13. The bonding of the extended portion 5 of the upper film 11 of the surface portion 1 with the lower film 12 of the side-surface portion 2 is made by heat fusing the second resin layer 14 of the upper film 11 with the protective layer 16 of the lower film 12. Because the extended portion 5 is folded back and heat fused, the adhesion between the films, and thus the strength of the ink pack 100 improves.

As illustrated in FIGS. 3A and 3B, the extended portion 5 of the upper film 11 is folded back and attached to the surface of the lower film 12 also at the shorter-side portions 18 of the surface portion 1. In this way, the metal layer 15 having a light-shielding property covers the base layers 13 (polyethylene layers) exposed at the end surface 6 of the joint portion 3, and can prevent the external ultraviolet rays from reaching the ink through the base layers 13. The bonding of the extended portion 5 of the upper film 11 of the surface portion 1 with the lower film 12 is made by heat fusing the second resin layer 14 of the upper film 11 with the protective layer 16 of the lower film 12.

The ink pack 100 is housed inside a casing 101 of an ink cartridge 150. The casing 101 has a form of a box, and is made of polymer material. A lid 102 is mounted on the top of the casing 101, and the ink supply opening 4 of the ink pack 100 is fixed to a cutout 103 of the casing 101 to construct the ink cartridge 150. The casing 101 of the ink cartridge 150 has large numbers of small holes 104 to save weight and material. The holes 104 are preferably sized so as not to distort the bag shape. Further, the holes 104 maybe arranged to provide visual access to the ink pack 100 inside. By indicating the ink pack 100 with the color of the ink contained therein, the color of the ink kept in the ink cartridge 150 can be checked without, for example, labeling the ink cartridge 150 with the color of the ink pack 100 kept therein. In this way, the ink cartridge 150 can be commonly used for the ink pack 100 of any color.

The ink pack 100 of the embodiment of the present invention can prevent entry of ultraviolet rays through the joint portion 3, and can thus prevent curing of the sealed ultraviolet curable ink over time. This makes it possible to set a longer shelf life for the ink, and prevent defective ink packs from occurring. Further, the casing 101 of the ink cartridge 150 does not need to be made of UV blocking material. Specifically, with the ink pack 100 housed inside the ink cartridge 150, any incoming external ultraviolet rays are blocked at the joint portion 3, and the ink does not cure. This allows the casing 101 to have the holes 104 to save weight and material.

The extended portion 5 may be configured from at least the metal layer 15. However, it is more preferable to form the extended portion 5 with the metal layer 15, and the second resin layer 14 or the protective layer 16 for the reinforcement of the metal layer 15, as in First Embodiment. Further, the extended portion 5, described as being provided on the upper film 11, may be provided on the lower film 12. In this case, the extended portion 5 of the lower film 12 is folded back to cover the end surface 6 of the base layers 13 after heat fusing the joint portion 3. In this way, external ultraviolet rays can be prevented from reaching the ink through the base layers 13.

As illustrated in FIG. 4, a thick resin layer may be provided only at the joint portion 3 of the ink pack 110. For example, a tape-like resin joint layer 31 is interposed at the longer-side portions 17 and the shorter-side portions 18 of the upper film 11 where the joint portion 3 will be formed, and the base layer 13 in the upper film 11 of the surface portion 1 is heat fused and joined to the base layer 13 in the film 20 of the side-surface portion 2 via the joint layer 31. In this case, because the extended portion 5 of the upper film is folded back to cover the end surface 6, entry of ultraviolet rays can be prevented despite that the end surface 6 has a wider exposed area. The upper film 11 and the lower film 12 can thus be joined with improved strength while preventing entry of ultraviolet rays at the end surface 6 of the joint portion 3.

FIGS. 5A and 5B are cross sectional views illustrating a joint portion 3 of an ink pack according to a variation of First Embodiment. As illustrated in FIG. 5A, an ink pack 120 has similar extended portions 5 in the upper film 11 of the surface portion 1 and the film 20 of the side-surface portion 2. As illustrated in FIG. 5B, the upper film 11 of the surface portion 1 and the film 20 of the side-surface portion 2 are joined to each other at the longer-side portions 17, and the extended portions 5 of the upper film 11 and the film 20 are heat fused from the opposite sides. The extended portions 5 cover the end surface 6 of the base layers 13 at the joint portion 3, and can prevent curing of the ink by blocking entry of ultraviolet rays through the end surface 6. The joining of the shorter-side portions 18 of the surface portion 1 is also made by heat fusing the extended portion 5 of the upper film 11 and the extended portion 5 of the lower film 12 to each other and covering the end surface 6 of the base layers 13. In this configuration, the extended portions 5 maybe configured from at least the metal layer 15. However, it is more preferable to form the extended portions 5 with the metal layer 15, and the second resin layer 14 or the protective layer 16 for the reinforcement of the metal layer 15, as above.

FIG. 6 is a cross sectional view illustrating a joint portion of an ink pack according to another variation of First Embodiment. As with the ink pack 120 of FIGS. 5A and 5B, an ink pack 130 has extended portions 5 in the upper film 11 of the surface portion 1 and the film 20 of the side-surface portion 2. The upper film 11 of the surface portion 1 and the film 20 of the side-surface portion 2 are joined to each other at the longer-side portions 17, and the extended portions 5 of the upper film 11 and the film 20 are laminated and heat fused from the opposite sides. The extended portion 5 of the upper film 11 is then folded back and layered over an end portion 21 of the film 20. The second resin layer 14 in the extended portion 5 of the upper film 11 is heat fused to the protective layer 16 of the film 20. The extended portions 5 cover the end surface 6 of the base layers 13 at the joint portion 3, and can prevent curing of the ink by blocking entry of ultraviolet rays through the end surface 6. In this configuration, the extended portions 5 may be configured from at least the metal layer 15. However, it is more preferable to form the extended portions 5 with the metal layer 15, and the second resin layer 14 or the protective layer 16 for the reinforcement of the metal layer 15, as above. The joining of the shorter-side portions 18 of the surface portion 1 is also made by heat fusing the extended portion 5 of the upper film 11 and the extended portion 5 of the lower film 12 to each other and covering the end surface 6 of the base layers 13 in the manner shown in FIG. 6.

Second Embodiment

Figure 7:
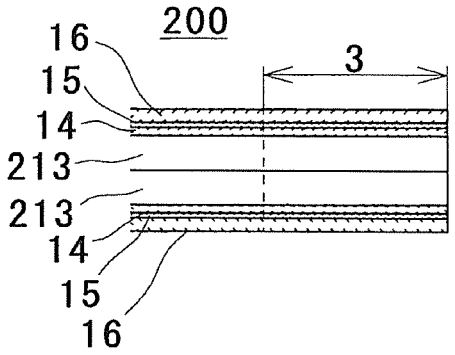
FIG. 7 is a cross sectional view illustrating a joint portion of an ink pack according to Second Embodiment of the present invention.

FIG. 7 is a cross sectional view illustrating a joint portion 3 of an ink pack according to Second Embodiment of the present invention. An ink pack 200 includes abase layer 213 configured from ultraviolet blocking resin. With the base layer 213 formed of ultraviolet blocking resin, any ultraviolet rays that enter the end surface 6 of the base layers 213 is blocked at the end surface 6, because the base layers 213 adhere to each other, even when the end surface 6 of the base layers 213 is exposed after the heat fusion of the base layers 213. Entry of ultraviolet rays into the ink pack can thus be prevented.

The ultraviolet blocking resin may be, for example, octyl methoxycinnamate, octyl dimethoxybenzylidene dioxoimidazolidine propenoate, hexyl diethylaminohydroxybenzoylbenzoate, t-butyl methoxydibenzoylmethane, octyl triazone, or p-methoxycinnamic acid 2-ethylhexyl ester.

Figure 8:
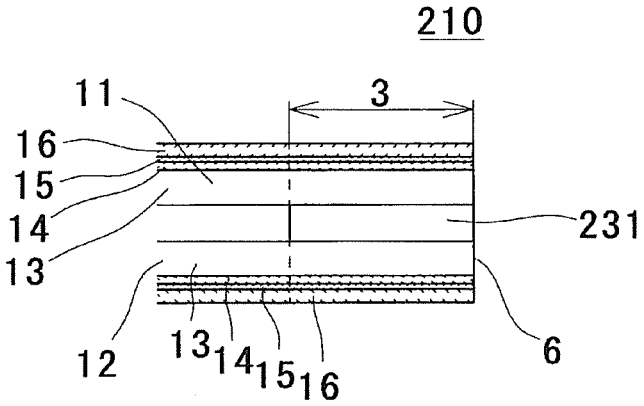
FIG. 8 is across sectional view illustrating a variation of the ink pack according to Second Embodiment of the present invention.

FIG. 8 is a cross sectional view representing a variation of the ink pack according to Second Embodiment of the present invention. An ink pack 210 includes a joint layer 231 of thick ultraviolet blocking resin only at the joint portion 3. For example, the joint layer 231 of ultraviolet blocking resin, tape-like in shape, is interposed at the longer-side portions 17 and the shorter-side portions 18 of the upper film 11 where the joint portion 3 will be formed. The base layer 13 in the upper film 11 of the surface portion 1 and the base layer 13 in the film 20 of the side-surface portion 2 are then heat fused and joined to each other with the joint layer 231 interposed in between. Here, because the ultraviolet blocking resin is sandwiched and exposed at the end surface 6, a large percentage of ultraviolet rays are blocked at the end surface 6. The ultraviolet blocking becomes more effective when the ink pack 210 is configured to include thin base layers 13 and a thick joint layer 231. Ultraviolet rays that obliquely fall on the end surface 6 of the base layers 13 can be absorbed and blocked. In Second Embodiment, the ultraviolet blocking resin may be replaced with ultraviolet scattering material.

Third Embodiment

Figure 9:
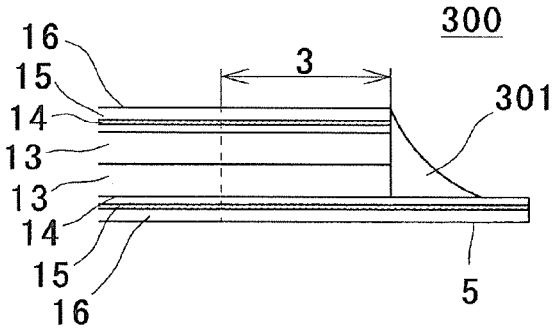
FIG. 9 is across sectional view illustrating an ink pack according to Third Embodiment of the present invention.
Figure 10:
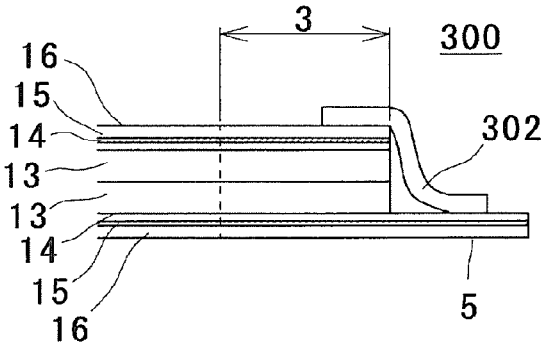
FIG. 10 is a cross sectional view illustrating a variation of the ink pack according to Third Embodiment of the present invention.

FIG. 9 is a cross sectional view illustrating an ink pack according to Third Embodiment of the present invention. An ink pack 300 includes an extended portion 5 in the lower film 12 of the surface portion 1, and an ultraviolet blocking resin is applied onto the extended portion 5 to cover the end surface 6 of the base layer 13. The second resin layer 14, the metal layer 15, and the protective layer 16 in the lower film 12 of the surface portion 1 protrude from the base layer 13 of the lower film 12 (extended portion 5). The upper film 11 and the lower film 12 are heat fused from the opposite sides at the longer-side portions 17. This exposes the end surface 6 of the base layer 13 sideways. Then, an ultraviolet blocking resin is applied on the extended portion 5, including the end surface 6, so as to form a coating layer 301 on the end surface 6. The coating layer 301 may be of a small width sufficient to cover the end surface 6 as shown in FIG. 9, or may be provided as a tape member 302 of ultraviolet blocking resin having a predetermined width that can cover the end surface 6, as shown in FIG. 10.

Fourth Embodiment

Figure 11:
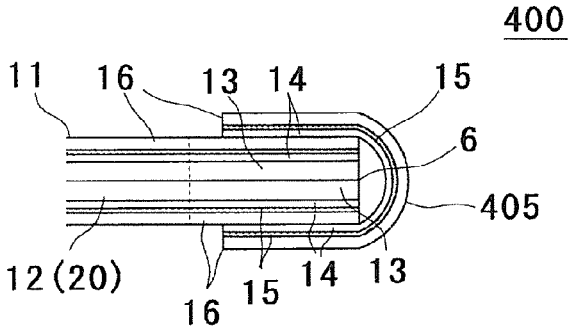
FIG. 11 is a cross sectional view illustrating an ink pack according to Fourth Embodiment of the present invention.
Figure 12:
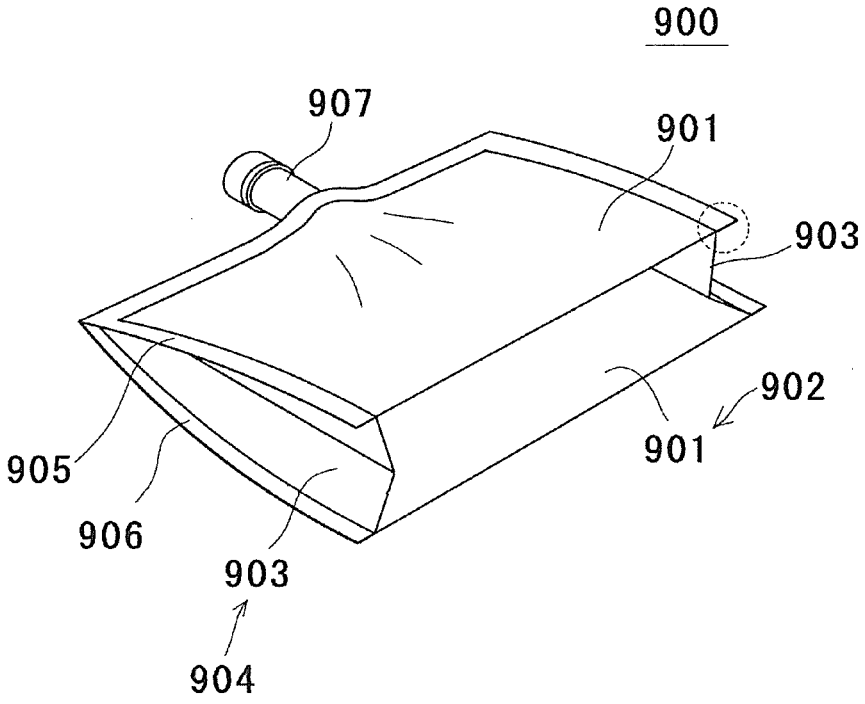
FIG.12 (Related Art)
FIG. 12 is a breakaway view illustrating an example of an ink pack of related art.
Figure 13:
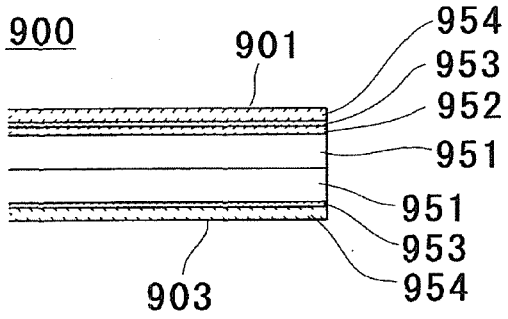
FIG.13 (Related Art)
FIG. 13 is a partially magnified cross sectional view of the ink pack shown in FIG. 12.

FIG. 11 is a cross sectional view illustrating an ink pack according to Fourth Embodiment of the present invention. An ink pack 400 is configured in substantially the same fashion as the ink pack shown in FIGS. 3A and 3B. The difference is that the extended portion 5 is a tape-like sealing element 405 separately provided from the upper film 11. Other configurations are the same as in First Embodiment, and will not be described. The sealing element 405 is provided by being heat fused over the surfaces of the upper film 11 and the lower film 12, completely covering the end surface 6. The sealing element 405 has the same structure as the upper film 11 and the lower film 12. The sealing element 405 may have a single-layer structure that includes only a light-shielding layer (not illustrated). The same effect obtained in First Embodiment also can be obtained with the ink pack configured this way.

In the foregoing First to Third Embodiments, each film is described as being configured as a laminate of a polyethylene film as the base layer 13, a polyester layer as the second resin layer 14, an aluminum film as the metal layer 15, and a polyester film as the protective layer 16, in this order. However, the invention is not limited to this configuration.

What is claimed is:

1. An ink pack formed by joining films into a form of a bag for sealing an ultraviolet curable ink therein, the ink pack comprising:

the films have a multilayer structure that includes a base layer of resin which an ultraviolet ray enters and a light-shielding layer laminated on the base layer, and are joined to each other at end portions of the base layers, the films each having an extended portion as a portion of the light-shielding layer extending from the base layer, the extended portions being directly joined to each other, and wherein one of the extended portions is folded back and joined at the end portion of other films by using the one of the extended portions for wrapping the end portion of other films, thus prevents entry of the ultraviolet ray through the base layer into an inside of the bag.

* * * * *